US006050887A

United States Patent [19]

Chang

[11] Patent Number: 6,050,887

[45] Date of Patent: Apr. 18, 2000

[54] SAND CLOTH PACKAGING STRUCTURE FOR VACUUM-TYPE ROTARY SANDERS

[76] Inventor: Hsueh Chin Chang, P.O. Box 63-150, Taichung City (406), Taiwan

[21] Appl. No.: 09/359,296

[22] Filed: Jul. 21, 1999

[30] Foreign Application Priority Data

Feb. 19, 1999 [TW] Taiwan ..... 88202804

[51] Int. Cl.[7] ..... B24B 19/00

[52] U.S. Cl. ..... 451/458; 451/359

[58] Field of Search ..... 451/359, 363, 451/386, 451, 458, 490, 491; 206/449, 555, 494, 501, 503

[56] References Cited

U.S. PATENT DOCUMENTS

| | | | |
|---|---|---|---|
| 3,875,703 | 4/1975 | Clemente | 51/170 T |
| 4,437,271 | 3/1984 | McAvoy | 51/400 |
| 4,789,065 | 12/1988 | Roy | 206/555 |
| 4,889,232 | 12/1989 | Asleson | 206/449 |

*Primary Examiner*—Timothy V. Eley
*Assistant Examiner*—Dung Van Nguyen

[57] ABSTRACT

A sand cloth packaging structure for vacuum-type rotary sanders comprised of sand cloths having a number of vacuum holes that are cluster mounted on the circular surface, with a number of support ribs that protrude upward from the bottom surface of the circular surface and, furthermore, are aligned within the circumference of the bottom surface. A surrounding annular wall extends along the outer diameter of the circumference and there are internal splines along the interior side of the annular wall that constitute a union opening which is congruous with the circumference of the bottom end. Positioned along the top surface of the said circular surface are a number of vertical guide posts that are in alignment with the vacuum holes of the said sand cloths and which are provided for insertion into the vacuum holes of the sand cloths. As such, the invention herein is an excellent enclosure for the said cluster mounted sand cloths that also provides for a rapid and guided procedure for replacing the sand cloths of vacuum-type rotary sanders.

4 Claims, 4 Drawing Sheets

SAND CLOTH PACKAGING STRUCTURE FOR VACUUM-TYPE ROTARY SANDERS

BACKGROUND OF THE INVENTION

1) Field of the Invention

The invention herein relates to a sand cloth packaging structure for vacuum-type rotary sanders, specifically a packaging structure that contains the specialized sand cloth utilized by vacuum-type rotary sanders.

2) Description of the Prior Art

The specialized sand cloth utilized on conventional vacuum-type rotary sanders, as indicated in FIG. 1, are attached to the fastening fabric 2 covering the entire surface of a circular head 1, with the congruous disk-shaped specialized sand cloth 3 being self-attached by a fastening fabric 4 covering the entirety of its back surface, such that when the specialized sand cloth 3 is replaced, the force is applied to pull and thereby separate the fastening fabric 2 from the fastening fabric 4, which is followed by the attachment of a new sheet of specialized sand cloth 3. Since clouds of fine particulate matter are produced during rotary sanding operation and the vacuum-type rotary sander is equipped with a built-in fans to induce collective suction through a number of passages 1A along the surface of the circular head 1, the said specialized sand cloth 3 is designed with a number of aligned vacuum holes 3A that allows the voluminous particulate matter to be collected inside the rotary sander through the vacuum holes 3A and the passages 1A of the circular head 1. However, as is well-known, vacuum-type rotary sander utilization requires the frequent replacement of the sand cloth. For example, metal vehicle panel or wood finishing involves the utilization of coarse, medium, or fine grades of sanding abrasion, with the operators often encountering the problem that the PU plastic or foam packaging of different brand sand cloths in the past lacked a means of product package identification and storage such that sheets of sand cloth were often scattered about in an unmanageable state after the packages were opened, further adding to the disordered array of tools at the work site, such that quickly finding the appropriate grade of sand cloth by the operators was even more difficult. Furthermore, after the appropriate sheet of specialized sand cloth 3 was found, the vacuum holes 3A in the surface of the specialized sand cloth 3 had to be rapidly but manually aligned correctly with each passage 1A of the circular head 1 in the tense setting of the work site, which was extremely difficult to accomplish because the fastening fabric 2 readily attached firmly to the fastening fabric 4 upon contact such that the fastening fabric 4 covering the rear of the entire disk-shaped surface of the specialized sand cloth 3 became attached to the fastening fabric 2 of the circular head 1 before each vacuum hole 3A was properly aligned with the passages 1A of the circular head 1. As a result, an arduous separation and reattachment operation had to be repeated several times, resulting in a considerable expenditure of labor and extreme working inconveniences. If the vacuum holes 3A and the passages 1A were not correctly aligned because of the degree of difficulty involved, dense clouds of particulate matter would permeate the air (vacuuming was precluded due to the blockage of the induction holes and passages) or more seriously, the working surfaces would be damaged or excessively abraded because the sand cloth 3 was not installed in perfect alignment with center of rotation and, furthermore, the said specialized sand cloth 3 would deteriorate into a worn condition faster.

In view of the said situation, the inventor of the invention herein based on many years of experience in the manufacturing and marketing of products in the same category, conducted extensive research and testing which culminated in the practical invention herein.

SUMMARY OF THE INVENTION

The primary objective of the invention herein is to provide a sand cloth packaging structure for vacuum-type rotary sanders that allows for the containment and identification of the specialized sand cloth as well as a rapid, accurate, and labor-saving replacement procedure of the specialized sand cloth.

Therefore, the sand cloth packaging structure for vacuum-type rotary sanders of the invention herein is comprised of sand cloths having a number of vacuum holes that are cluster mounted on the circular surface, with a number of support ribs that protrude upward from the bottom surface of the circular surface and, furthermore, are aligned within the circumference of the bottom surface. A surrounding annular wall extends along the outer diameter of the circumference and there are internal splines along the interior side of the annular wall that constitute a union opening which is congruous with the circumference of the bottom end. Positioned along the top surface of the said circular surface are a number of vertical guide posts that are in alignment with the vacuum holes of the said sand cloths and which are provided for insertion into the vacuum holes of the sand cloths. As such, the invention herein achieves the excellent clustered containment of the sand cloths as well as a rapid and guided procedure for replacing the sand cloths of vacuum-type rotary sanders.

To enable the examination committee to further understand the objectives, the innovations, and the advantages of the invention herein, the brief description of the drawings below are followed by the detailed description of the preferred embodiments of the invention herein.

DETAILED DESCRIPTION OF THE PREFERRED EMBODIMENTS

Figure 1:
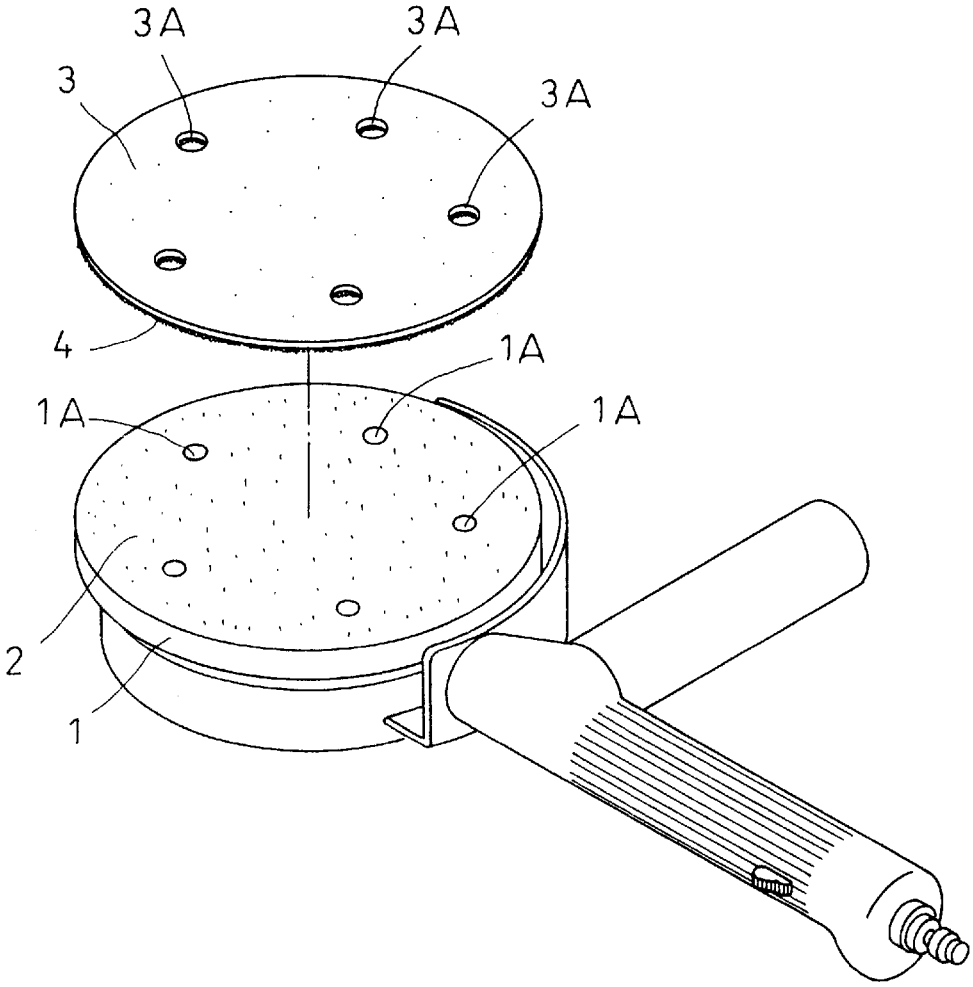
FIG. 1 PRIOR ART
FIG. 1 is an isometric drawing illustrating the operation of a conventional vacuum-type rotary sander and sand cloth.
Figure 2:
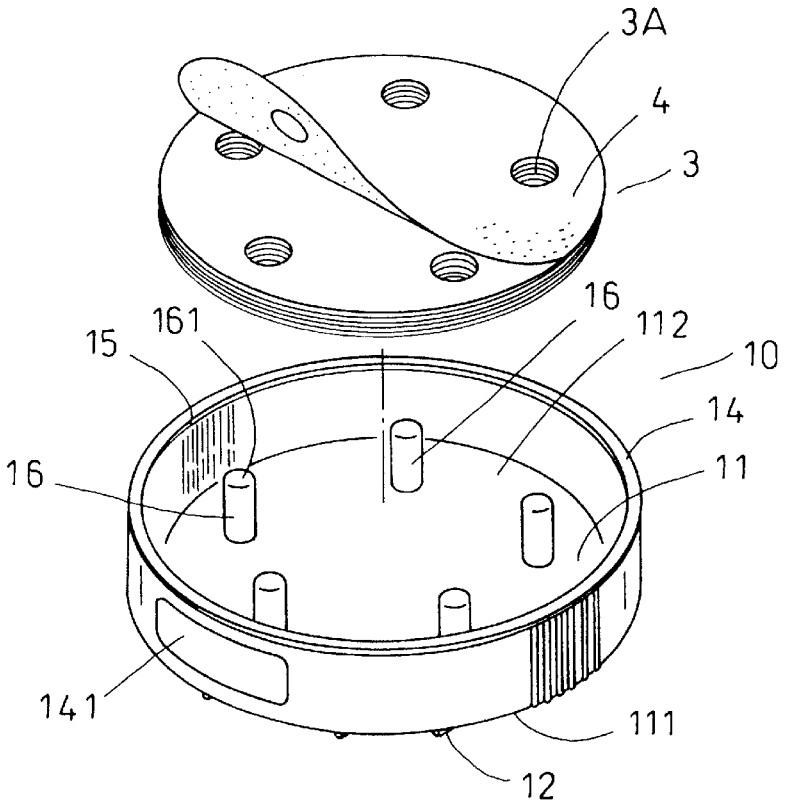
FIG. 2 is an exploded isometric drawing of the preferred embodiment of the invention herein.
Figure 3:
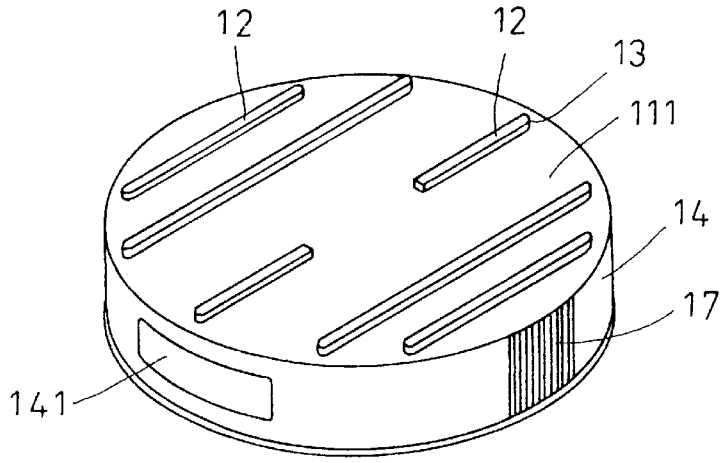
FIG. 3 is an isometric drawing of the back section in invisible view of the preferred embodiment of the invention herein.

Referring to FIG. 2, the sand cloth packaging structure 10 for vacuum-type rotary sanders of the invention herein is comprised of sand cloths 3 having a number of vacuum holes 3A and that are cluster mounted on the circular surface 11, with a number of support ribs 12 protruding upward from the bottom surface 111 of the said circular surface and, as indicated in FIG. 3, the said support ribs 12 are configured at intervals apart in parallel on the said circular surface 11 relative to its diameter such that they are conformable to the circumferential area of the bottom end 13 and, furthermore, a surrounding annular wall 14 extends along the outer diameter of the circumference, and there is a horizontally oriented recess 141 in the exterior of the said annular wall 14 for holding a label bearing the sand cloth specifications and brand; there are internal splines along the interior side of said annular wall 14 that constitute the union opening 15 which is congruous with the circumference of the bottom end 13; positioned along the top surface 112 of the said circular surface 11 are a number of vertical guide posts 16 that are in alignment with the vacuum holes 3A of the said sand cloths 3, with the top ends 161 of the said guide posts 16 being of a gradually skewed diameter to accommodate insertion into the vacuum holes 3A of the sand cloths 3.

There are a number of vertical serrations 17 along the circumference of said annular wall 14 on the circular surface 11 to facilitate manual grasping.

Figure 4:
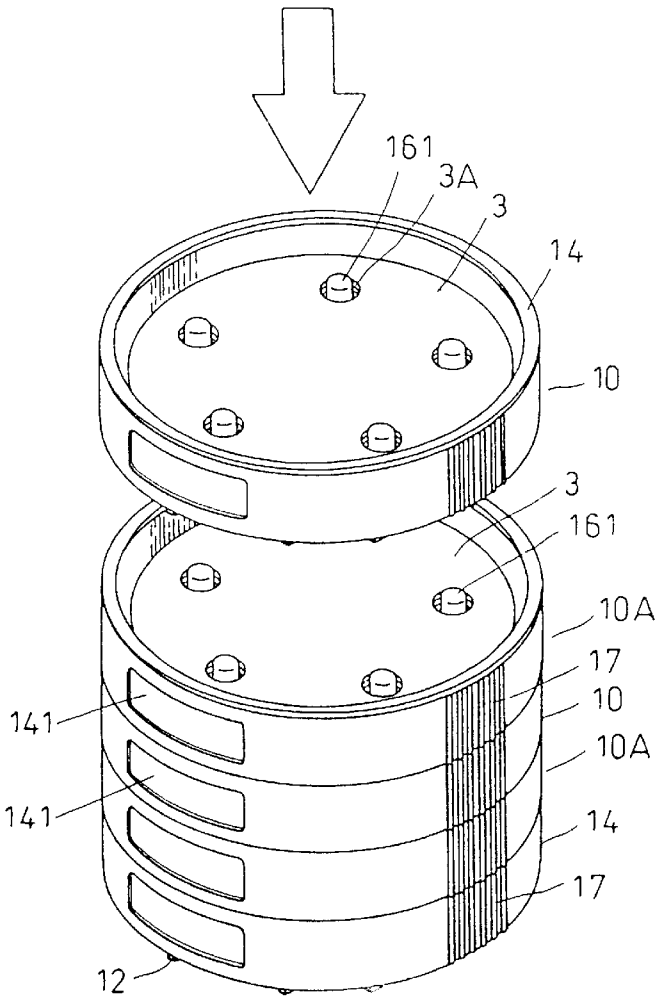
FIG. 4 is an isometric drawing of the invention herein when stack assembled.
Figure 5:
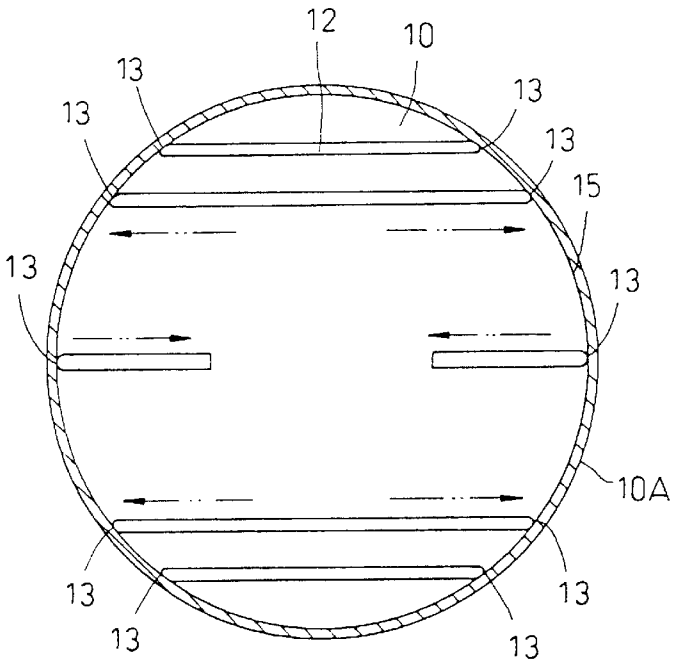
FIG. 5 is a cross-sectional drawing of the invention herein when stack assembled.

To assemble the aforesaid components comprising the sand cloth packaging structure for vacuum-type rotary sanders of the invention herein, as indicated in FIG. 2 and FIG. 4, already in a clustered arrangement, a number of sand cloths 3 with all the vacuum holes 3A in a state of alignment are ensconced onto the circular surface 11 of the invention herein, with the inserted guide posts 16 maintaining their position when the product leaves the factory; after the said packaging is completed, as indicated in FIG. 4 and FIG. 5, due to the design of the invention herein featuring a number of support ribs 12 configured at intervals apart in parallel on the said circular surface 11 relative to its diameter such that they are conformable with the circumferential area of the bottom end 13, the circumference of the said bottom end 13 is coincides exactly with the union opening 15 along the interior side of the said annular wall 14; as a result, two packaging structures containing sand cloth of different specifications can be ensleeved and thereby stacked vertically and, as indicated in FIG. 5, the upper packaging structure 10 utilizes the aligned circumference of the bottom end 13 for coupling into the union opening 15 of the lower packaging structure 10A and as such, the said upper and lower packaging structures are integrated into a single physical entity that facilitates carrying and storage; furthermore, the support ribs 12 along the underside of the packaging structure 10 provides enhanced structural reinforcement during contact against surfaces, with the configuration at parallel intervals allowing air flow over the bottom end 13.

Figure 6:
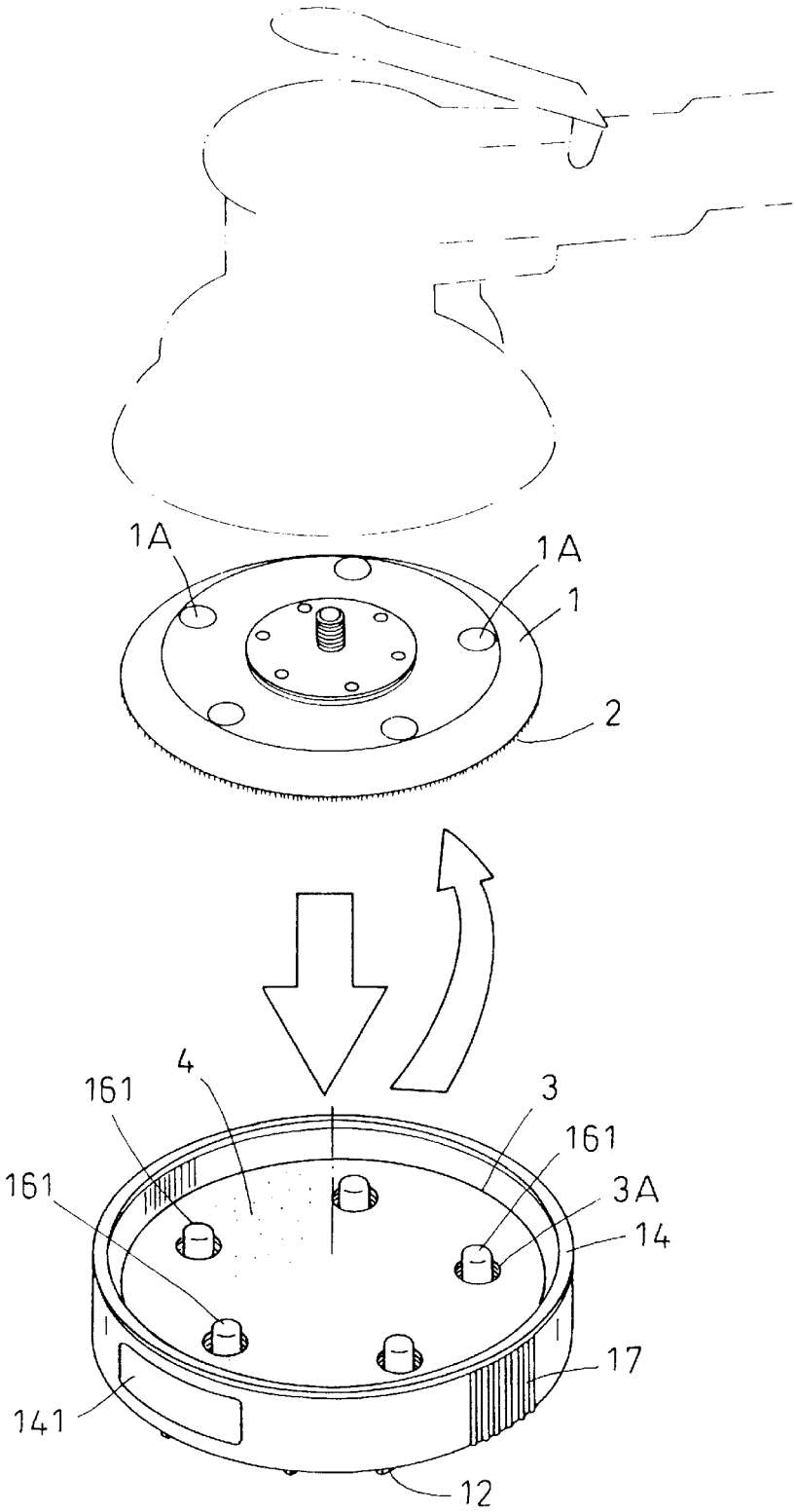
FIG. 6 is an isometric drawing of the invention herein, illustrating the replacement of the sanding disk.

When the sand cloth 3 on the vacuum-type rotary sander head 1 needs to be replaced by the user as indicated in FIG. 6, the insertion hole 1A of the rotary sander head 1 is faced towards the packaging structure 10 of the invention herein and the surrounding annular wall 14 is guided to rapidly insert the vacuum-type rotary sander head 1 into the upper extent of the said clustered sand cloth 3 and, at the same time, the top ends 161 of the guide posts 16 at the visible side of the sand cloth 3 cause the fastening fabric 2 on the end surface of the said vacuum-type rotary sander head 1 to become rapidly attached to the fastening fabric 4 of the sand cloth 3 at the uppermost layer and, in the invention herein, the guide posts 16 axially inserted from below maintain the said vacuum holes 3A of the said sand cloth 3 so attached in exact contact and alignment with the insertion holes 1A of the vacuum-type rotary sander head 1; and the vacuum-type rotary sander head sand cloth replacement operation is completed when the vacuum-type rotary sander head 1 is lifted and separated from the packaging structure 10.

In summation of the foregoing section, since the structural technological concepts and innovative spatial configuration of the sand cloth packaging structure for vacuum-type rotary sanders of the invention herein successfully surmounts the conventional limitations and achieves the objective of providing an effective containment and identification structure for sand cloth as well as offering a rapid, labor-saving and, furthermore, accurate replacement procedure, the invention herein possesses greater practical value than conventional sand cloth packaging stuctures.

What is claimed is:

1. A sand cloth packaging structure for vacuum-type rotary sanders comprising sand cloths having a number of vacuum holes that are cluster mounted on a circular surface, with a number of support ribs protruding upward from a bottom surface of said circular surface and, furthermore, are aligned within a circumferential area of said bottom surface; a surrounding annular wall extends along the outer diameter of the circumference and there are internal splines along the interior side of said annular wall that constitute a union opening which is congruous with the circumference of said bottom surface; positioned along the top surface of said circular surface are a number of vertical guide posts that are in alignment with said vacuum holes of said sand cloths and which are provided for insertion into said vacuum holes of said sand cloths; thereby achieving an excellent enclosure for said cluster mounted sand cloths that also provides for a rapid and guided for replacing the sand cloth of vacuum-type rotary sanders.

2. The sand cloth packaging structure for vacuum-type rotary sanders as in claim 1, wherein said support ribs are configured at intervals apart in parallel on said circular surface relative to its diameter such that said support ribs are conformable with the circumferential area of said bottom surface.

3. The sand cloth packaging structure for vacuum-type rotary sanders as in claim 1, wherein a number of vertical serrations along the circumference of said annular wall extending from said circular surface.

4. The sand cloth packaging structure for vacuum-type rotary sanders as in claim 1, wherein top ends of said guide posts are of a gradually skewed diameter to accommodate insertion into said vacuum holes of said sand cloths.

* * * * *